US006739517B1

(12) United States Patent
Krueger

(10) Patent No.: US 6,739,517 B1
(45) Date of Patent: May 25, 2004

(54) NON-CIRCULATING TANK AND KIT FOR USE WITH LIQUID HEATING UNIT

(76) Inventor: Gregory A. Krueger, 815 Plum St., Eau Claire, WI (US) 54703

( * ) Notice: Subject to any disclaimer, the term of this patent is extended or adjusted under 35 U.S.C. 154(b) by 0 days.

(21) Appl. No.: 09/981,616

(22) Filed: Oct. 15, 2001

(51) Int. Cl.[7] ..... F24D 3/08

(52) U.S. Cl. ..... 237/19; 237/16; 237/59; 237/66; 122/13.01

(58) Field of Search ..... 237/66, 7, 70; 165/70; 122/13.01, 13.3, DIG. 10; 392/441, 444

(56) References Cited

U.S. PATENT DOCUMENTS

| | | | | | |
|---|---|---|---|---|---|
| 1,418,583 | A | | 6/1922 | Lincke et al. | |
| 2,115,706 | A | * | 5/1938 | Cornell, Jr. | 165/219 |
| 3,554,441 | A | | 1/1971 | Malmstrom et al. | |
| 3,850,230 | A | * | 11/1974 | Margen | 165/140 |
| 4,278,230 | A | * | 7/1981 | Allen | 165/104.32 |
| 4,296,883 | A | | 10/1981 | Yanna | |
| 4,601,426 | A | | 7/1986 | Brosenius | |
| 4,656,836 | A | * | 4/1987 | Gilbertson | 137/565.34 |
| 4,915,296 | A | * | 4/1990 | Matsumoto et al. | 237/60 |
| 4,921,166 | A | * | 5/1990 | Matsumoto et al. | 237/59 |
| 5,007,583 | A | | 4/1991 | Schwarz | |
| 5,372,185 | A | * | 12/1994 | Lannes | 122/15.1 |

OTHER PUBLICATIONS

Gregory A. Krueger, U.S. patent application Ser. No. 09/416,601 for Non–externally Pressurized Space Heating System and Apparatus, Filed Oct. 11, 1999.

* cited by examiner

*Primary Examiner*—Derek S. Boles
(74) *Attorney, Agent, or Firm*—Anthony J. Bourget

(57) ABSTRACT

A tank for use with a liquid heating vessel of a hydronic radiant heating system to assist in the simultaneous sealing and venting of air from the system where the heating vessel has a flue for release of exhaust, the tank including a liquid holder that is exposed to the atmosphere and an aperture defined in the holder such that the flue of the vessel may extend upward through the aperture of the tank.

14 Claims, 9 Drawing Sheets

NON-CIRCULATING TANK AND KIT FOR USE WITH LIQUID HEATING UNIT

CROSS-REFERENCE TO RELATED APPLICATIONS, IF ANY

Applicant is owner of pending U.S. patent application Ser. No. 09/416,608, filed Oct. 12, 1999, for Non-Externally Pressurized Space Heating System and Apparatus.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates generally to a tank for holding liquid, and more specifically, to a tank for use with a liquid heating unit of a hydronic radiant heating system.

2. Background Information

The use of radiant heating systems is well known. Most systems utilize a pressurized source for supply of water or heating liquid. Recently it has been discovered that a non-externally pressurized space heating system is available for preferred use. Such system is disclosed in U.S. patent application Ser. No. 09/416,608, filed Oct. 12, 1999. Such system utilizes a ballast or reservoir for, among other reasons, releasing air contained within the heating system. Use of such system and ballast helps in overcoming some inherent drawbacks of typical radiant heating systems and the assembly of the systems.

Some examples of inventions concerned with the use of heating systems and radiant heating systems for which patents have been granted are found in the following: U.S. Pat. No. 5,007,583; Schwarz, U.S. Pat. No. 4,296,883; Yanna, U.S. Pat. No. 3,554,441; Malmstrom, Carlson, U.S. Pat. No. 1,418,583; Lincke et al.

None of these patents provide a non-externally pressurized space heating system that utilizes a non-circulating releasing means for releasing air contained within the system or that utilize a tank having unique features such that a flue of a heating vessel may extend therethrough. Consequently, applicant has invented a tank for use with a liquid heating vessel of a hydronic radiant heating system to accommodate extension of the flue, while providing many additional features that are unique to the structure described herein.

SUMMARY OF THE INVENTION

The present invention is directed to a tank for use with a liquid heating vessel of a hydronic radiant heating system, the heating vessel having a flue for release of exhaust. The tank includes a liquid holding means for holding liquid utilized with the heating system and an aperture means for receiving the flue which extends therethrough, the aperture means defined by the liquid holding means.

The present invention may preferably be used in conjunction with a heating vessel and system such as that described in U.S. patent application Ser. No. 09/416,608. A standard heating vessel can be used in conjunction with the invention.

A further embodiment of the present invention includes a do-it-yourself hydronic space heating kit for assembly of a space heating system utilizing a heat vessel for heating liquid, the heat vessel having a flue, piping connected to the heat vessel for receiving heated liquid and circulating the heated liquid throughout coils and back to the heat vessel, the kit including a tank for holding water, the tank including an aperture, the aperture adapted to receive the flue which extends therethrough, and the tank having releasing means for releasing air contained within the system. The kit may also include a circulating pump sized to connect with the piping; a connecting means, such as a flexible tubing, to connect the tank to the vessel; or a pipe nipple to assist in connecting the tank to the vessel. Other system components may be added to the kit as desired.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
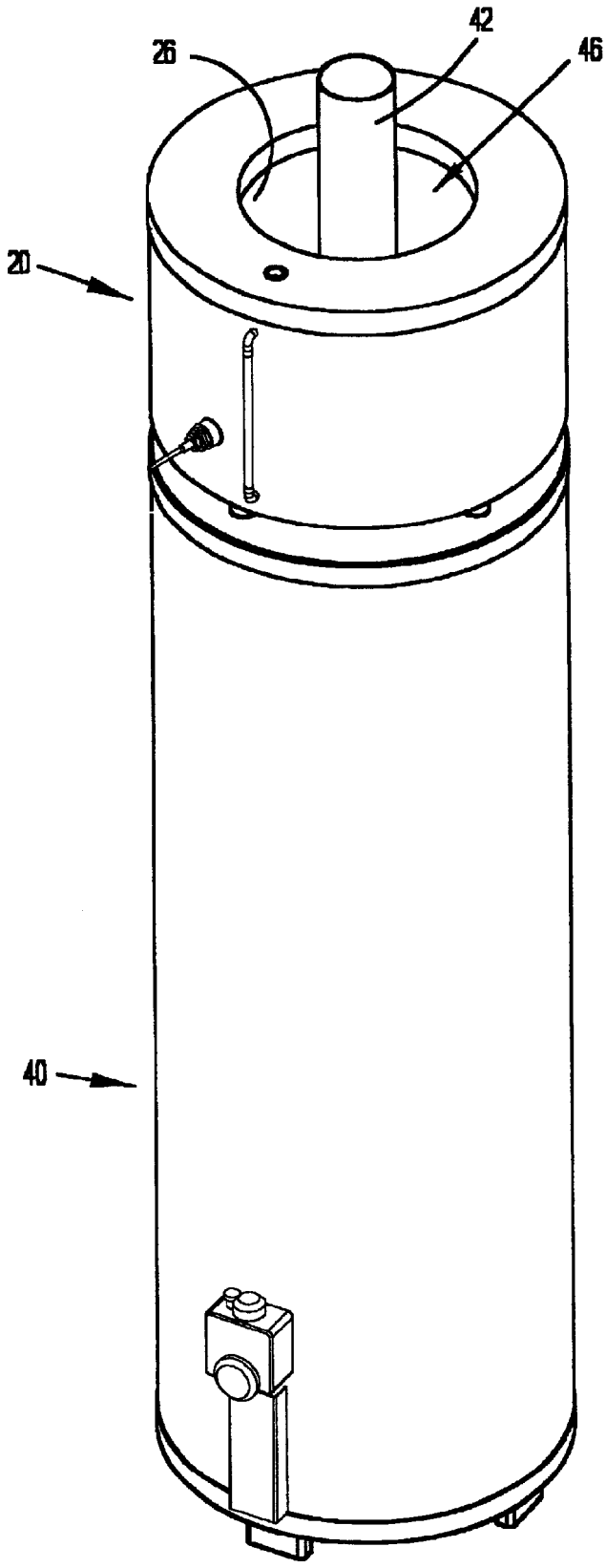
FIG. 1 is a perspective view of one embodiment of the present invention, the tank positioned atop a heating vessel.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DESCRIPTION OF THE EMBODIMENTS

The present invention is directed to a tank that is used in conjunction with a liquid heating vessel of a hydronic radiant heating system. The heating vessels have a flue for release of exhaust. A heating vessel may be of a general water heater type or of a boiler type, each of which generally require venting of exhaust or vapors. Venting of exhaust is typically accomplished by use of a flue that extends from the water heater or boiler to the open atmosphere or other space. The tank is designed to be positioned atop the heating vessel for appropriate and convenient use and assembly.

Figure 2:
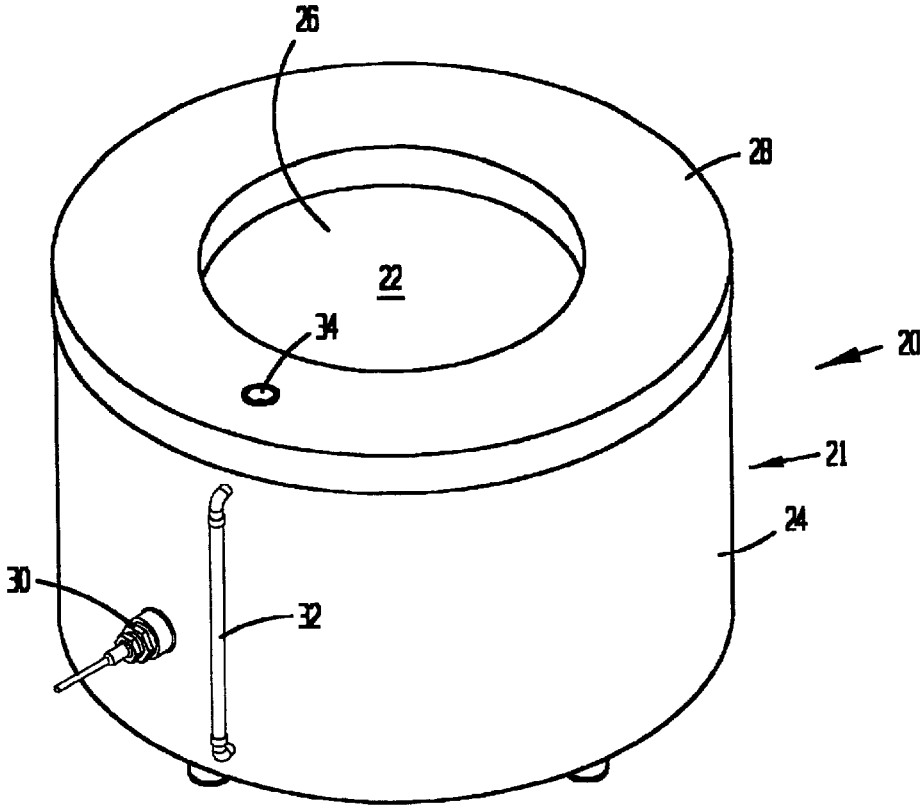
FIG. 2 is a perspective view of the present invention.
Figure 3:
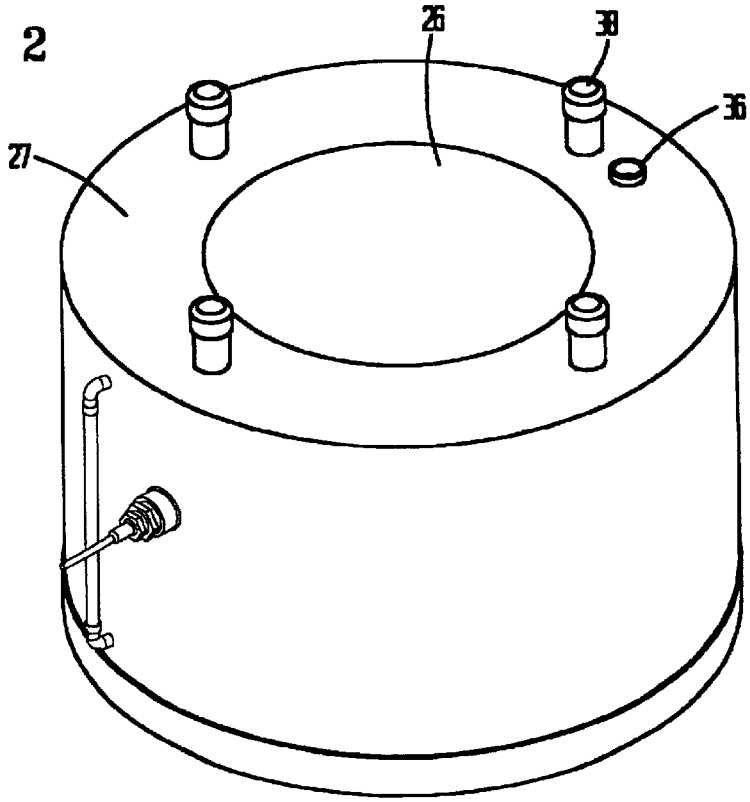
FIG. 3 is a bottom perspective view of the invention shown in FIG. 2.
Figure 10:
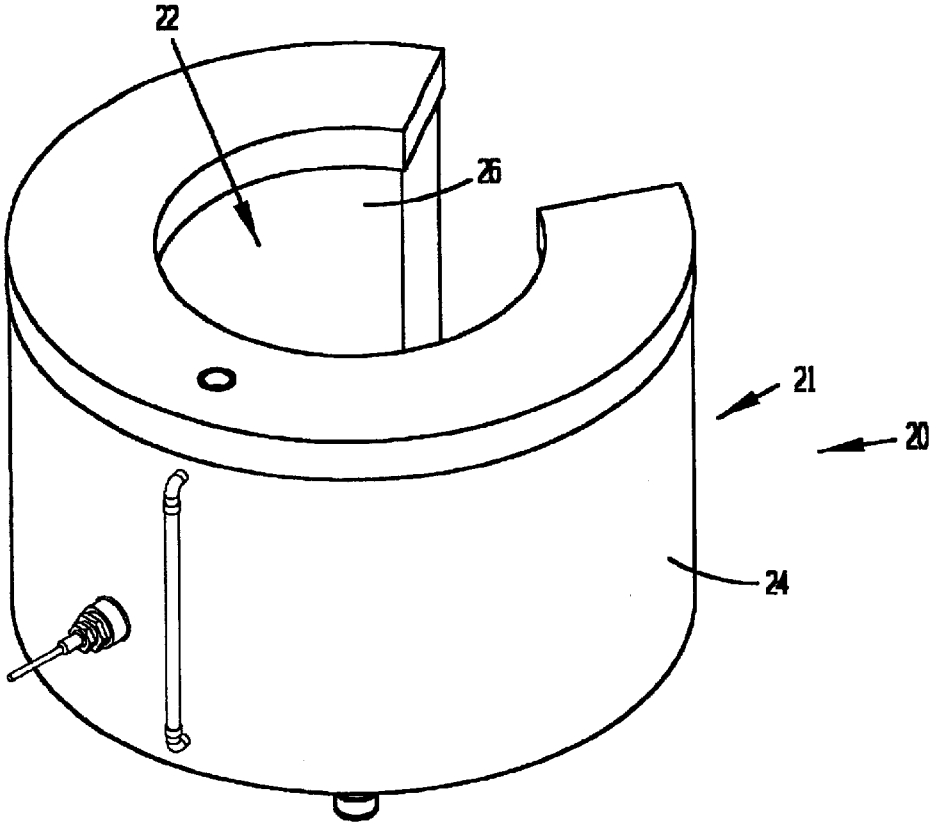
FIG. 10 is a perspective view of the invention.
Figure 11:
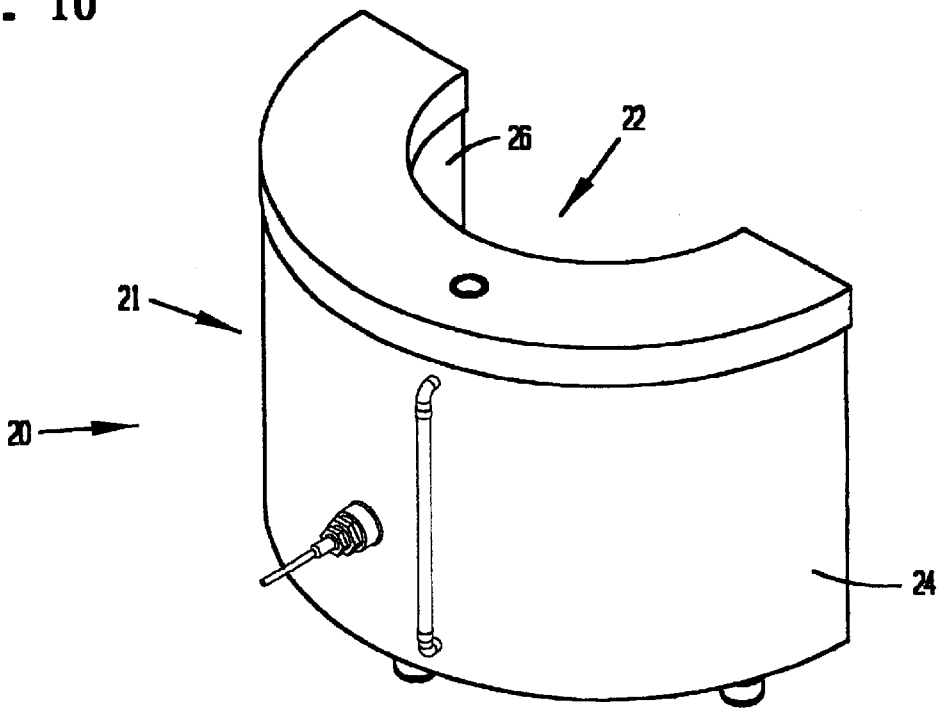
FIG. 11 is a perspective view of the invention.

Referring to FIGS. 1–3, one embodiment of the present invention is shown where the tank 20 is positioned atop water heater or vessel 40. Vessel 40 holds liquid which is heated for use in a heating system. Tank 20 includes a liquid holder 21. Liquid holder 21 may be one of a variety of articles capable of holding liquid, preferably made of light-weight easily manufactured material such as sheet metal or plastic materials. Tank 20 includes aperture 22 through which the flue 42 of the heating vessel 40 extends. As shown in FIGS. 1–3, tank 20 is substantially doughnut shaped but may be adapted to a configuration suitable for accommodating the extension of flue 42. Aperture 22 allows for convenient placement of tank 20 about vessel 40. FIG. 10 illustrates tank 20 in a substantially horseshoe configuration. This allows for easy attachment or detachment of tank 20 to a vessel 40 that is already fitted with flue 42 because flue 42 need not be removed for such connection. The horseshoe configuration also allows for ease of maintenance or repair of the system or system components. FIG. 11 illustrates tank 20 in a substantially C-shaped configuration. Such configuration also allows for easier connection or detachment of the tank from a heating vessel. Such configuration further accommodates for use of a power-vent atop the vessel 40. It may be appreciated that a variety of configurations may be used in order to achieve the required results. Moreover, tank 20 may be of a wall-mounted variety as long as it includes an aperture 22 for extension of flue 42. Aperture 22 runs substantially vertically through tank 20.

Figure 8:
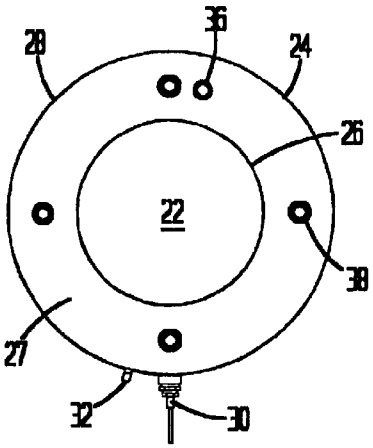
FIG. 8 is a bottom view of the invention.
Figure 7:
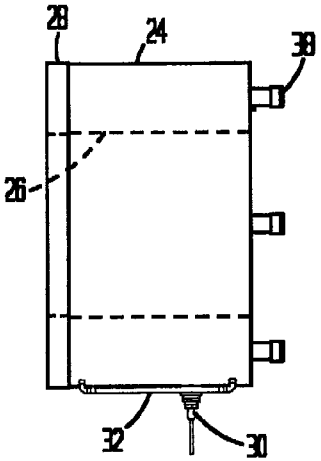
FIG. 7 is a further side view of the invention.
Figure 9:
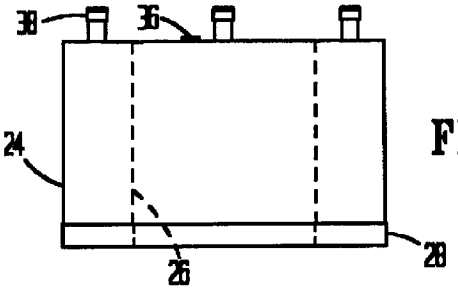
FIG. 9 is a back view of the invention.
Figure 12:
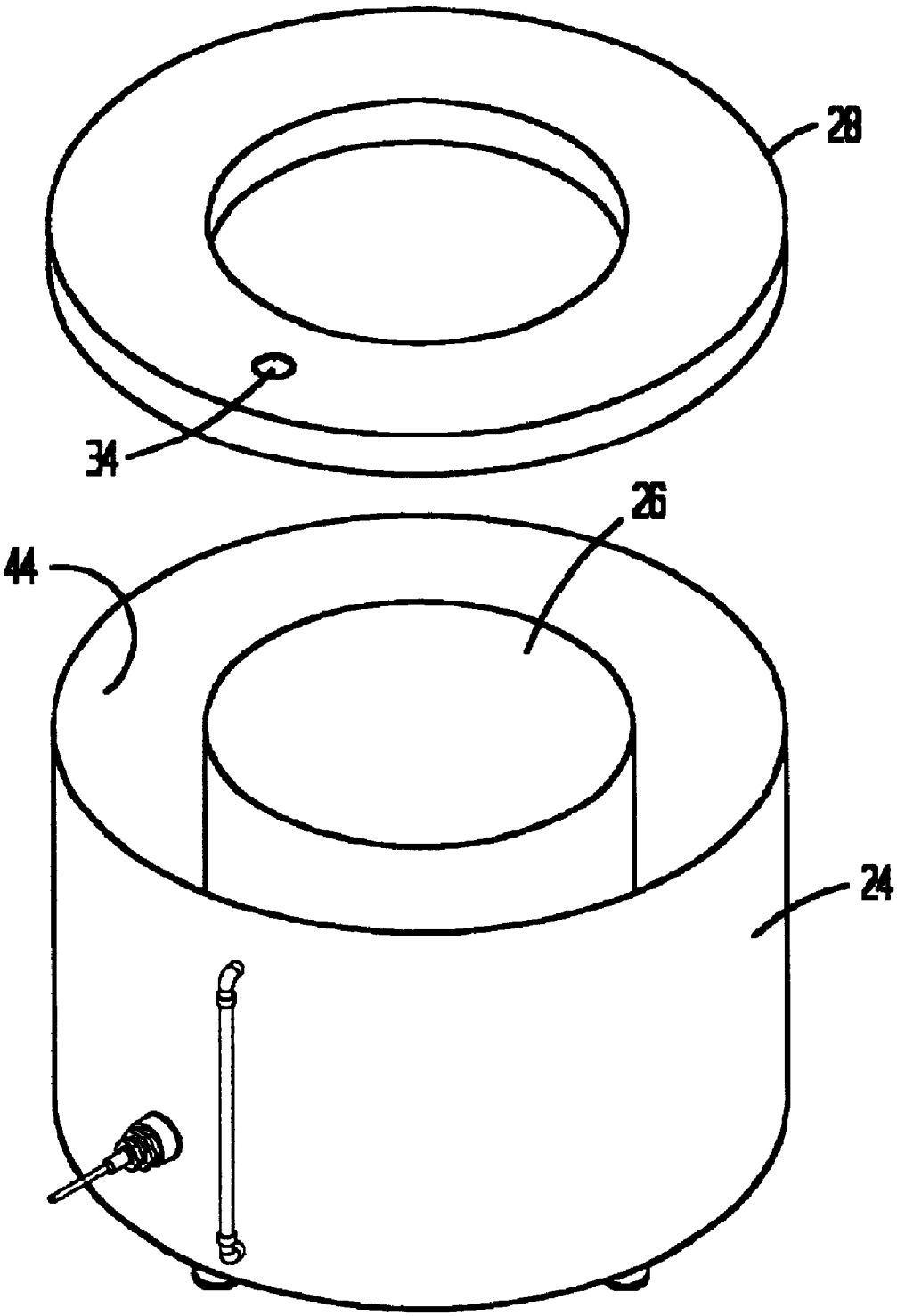
FIG. 12 is a perspective view of the invention.

As shown in FIGS. 2, 8 and 12, liquid holder 21 includes inner tank wall 26, outer tank wall 24, and bottom tank wall 27. Such configuration defines a trough 44 in which liquid is retained. Tank 20 may optionally include cover 28 to cover trough 44 which protects against insertion of articles or dust. Cover 28 may be secured in place with a variety of connection means. Preferably cover 28 may be selectively removed. Cover 28 includes refill port 34 which assists in the refill of liquid if necessary. Refill port also exposes liquid within trough 44 to the atmosphere and facilitates release of air bubbles from the system. Without cover 28 the trough 44 is substantially open to the atmosphere. Open air trough 44 and refill port 34 may each operate as air release means. It can be appreciated that other configurations are available for air release means such that the water within tank 20 is exposed to the atmosphere.

As shown in FIG. 1, inner wall 26 and flue 42 define a clearance 46 which allows flue 42 to extend through tank 20 such that there is no or minimal contact between flue 42 and tank 20. It can be appreciated that such clearance may vary as desired. It is possible to not include a clearance such that the inner wall 26 and flue 42 abut, however applicant has found the present configuration preferable so as to minimize temperature increases in the liquid within tank 20. Maintaining temperature assists in control of evaporation.

In operation, liquid does not actively circulate through tank 20 into the system or vessel 40. Tank 20 is non-circulating. There is no input of liquid to tank 20 from the liquid circulating system. Rather, the liquid in tank 20 is present to isolate the system from the atmosphere and to provide automatic air bubble release means. If air bubbles are released from the vessel and system through tank 20, an equal volume of liquid is readily available for replacing the air bubble to allow for efficient operation of the system. The non-circulation also isolates the liquid in the tank 20 from active circulation within the system so that the liquid remains at atmospheric pressure and ambient temperature which lessens evaporation. The liquid is generally a mixture of water and glycol which is commonly used in radiant heating systems. If necessary, liquid can be easily added to tank 20. Because the system is non-externally pressurized, and open to the atmosphere, a user can pour liquid directly into tank 20.

Figure 6:
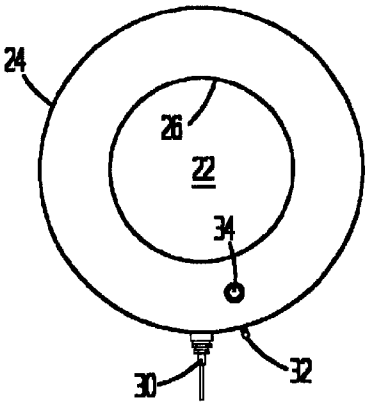
FIG. 6 is a top view of the invention.
Figure 4:
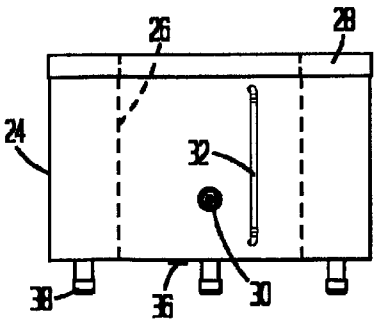
FIG. 4 is a front view of the invention.
Figure 5:
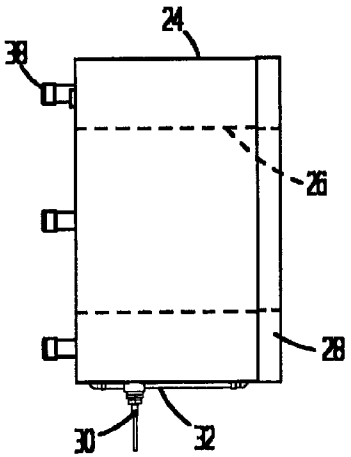
FIG. 5 is a side view of the invention.

Referring to FIGS. 4–9, various views of the present invention are shown. As shown in FIGS. 4 and 6, aperture 22 runs vertically through tank 20. Tank 20 further includes optional indicator 32 which preferably includes a transparent element in order to ascertain and monitor the liquid level within tank 20.

Figure 16:
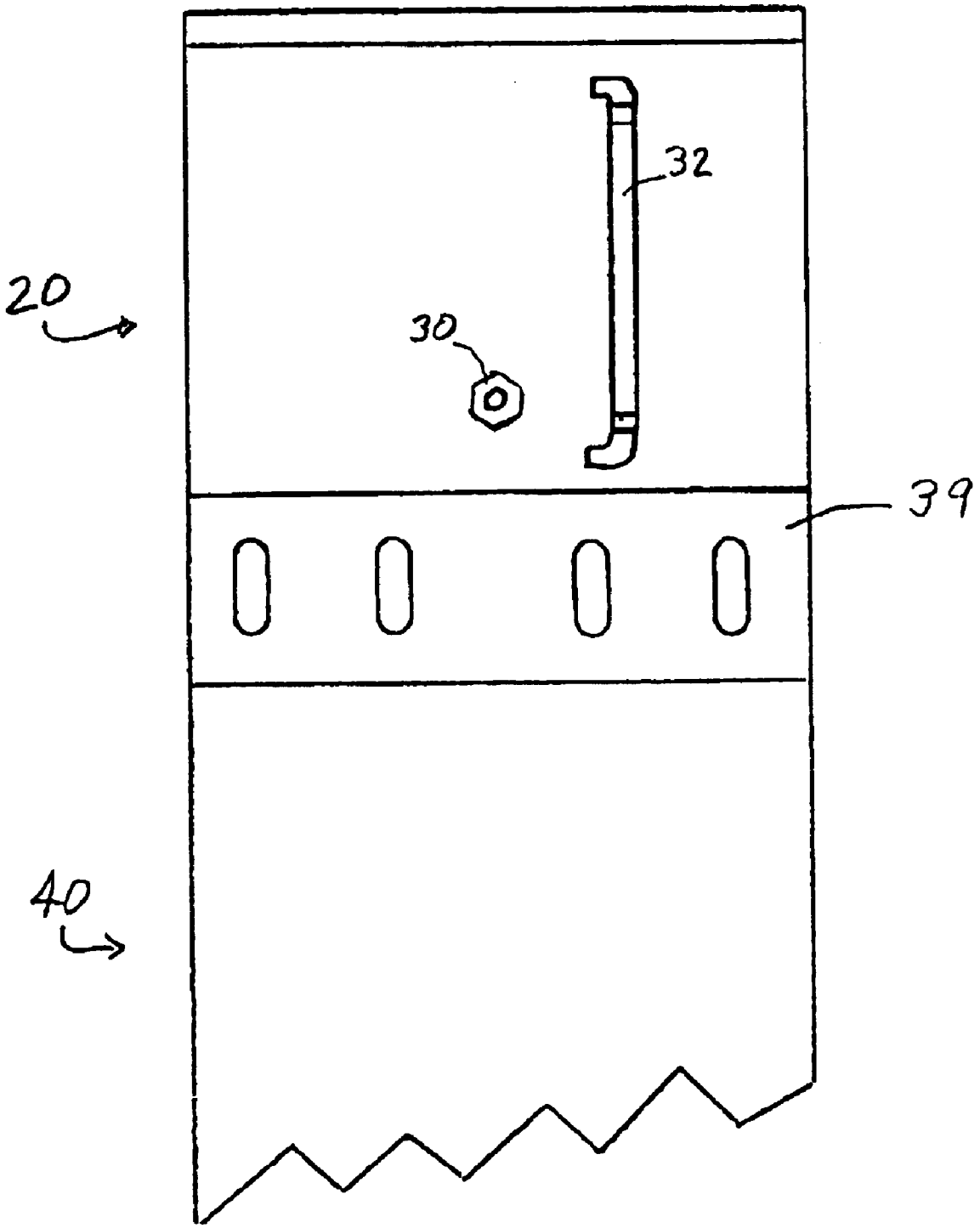
FIG. 16 is a partial front view of the present invention showing use of a strip between the tank and a vessel.
Figure 18:
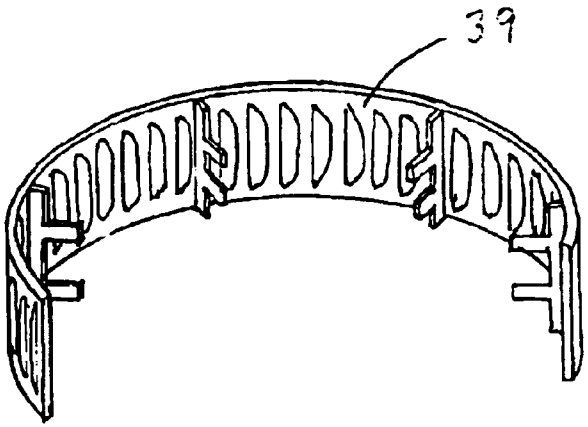
FIG. 18 is a perspective view of the detached strip shown in FIG. 17.
Figure 17:
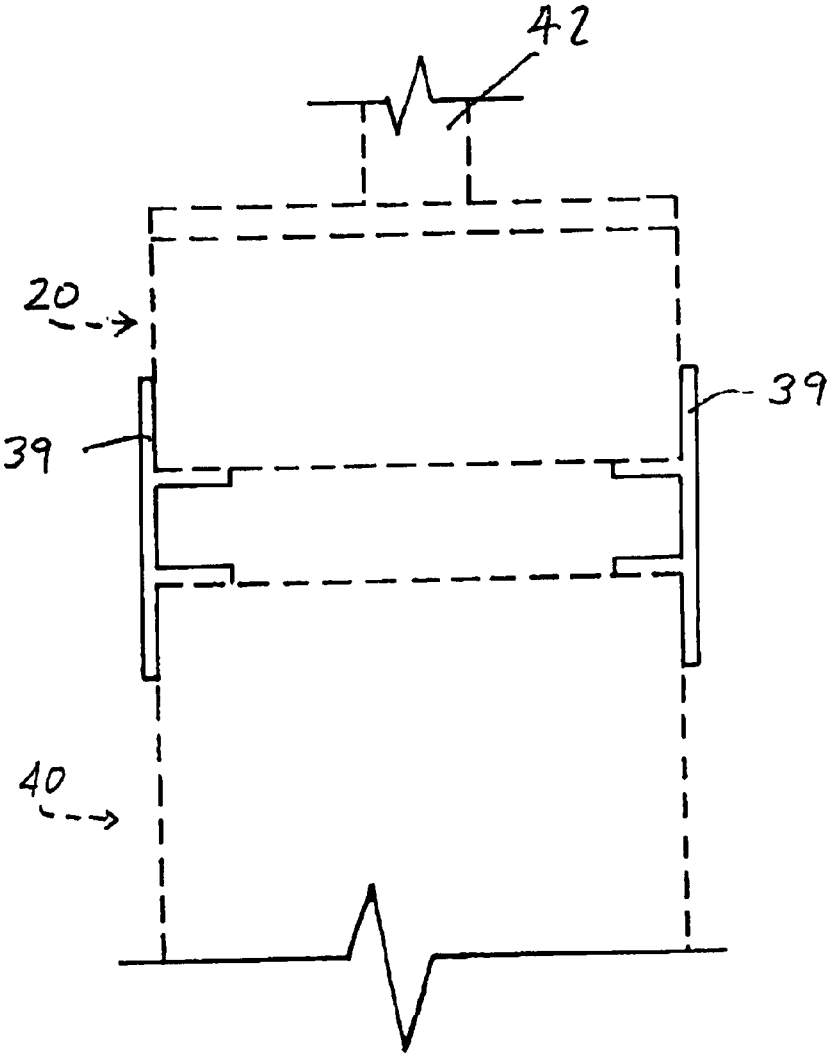
FIG. 17 is a front section view of a strip in relation to the tank and vessel.

Tank 20 further includes optional leg or legs 38 to allow placement above or on top of vessel 40. Legs 38 provide separation between tank 20 and vessel 40 which accommodates connection of tank 20 to vessel 40. Such separation also allows piping from the circulating coil system to be connected to a return port which is commonly configured on top of the vessel 40. Such separation further allows for use of a draft hood to be positioned atop the vessel 40. A draft hood is commonly used in a standard vessel to assist in venting of exhaust. Piping from the circulating coil system may be positioned beneath tank 20 for connection to the return port, or alternatively such piping may extend through the aperture 22. If piping extends through the aperture 22, tank 20 should be configured such that a portion of tank 20 extends above the upper-most location of the piping. Legs 38 operate as leg means to provide separation. It can be appreciated that other leg means is contemplated in order to provide such separation, including use of a strip of sheet metal which extends from tank 20 or other material disposed to provide desired separation. As shown in FIGS. 16–18, strip 39 may be used to provide desired separation.

Outlet port 36 connects with vessel 40 so that liquid within tank 20 communicates with vessel 40. It may be appreciated that a variety of connecting means are available to connect port 36 with vessel 40. A pipe nipple configuration is used. Preferably, a flexible tubing extends from port 36 to connect with a receiving port of the vessel 40.

Tank 20 further includes optional liquid actuated safety switch 30 which monitors the level of water within tank 20 and operates as a safety mechanism in the event of a low liquid situation. If necessary, switch 30 may operate to shut down the system in the case of a low liquid condition. An optional refill switch may also be included to automatically replenish tank 20 if necessary.

Figure 13:
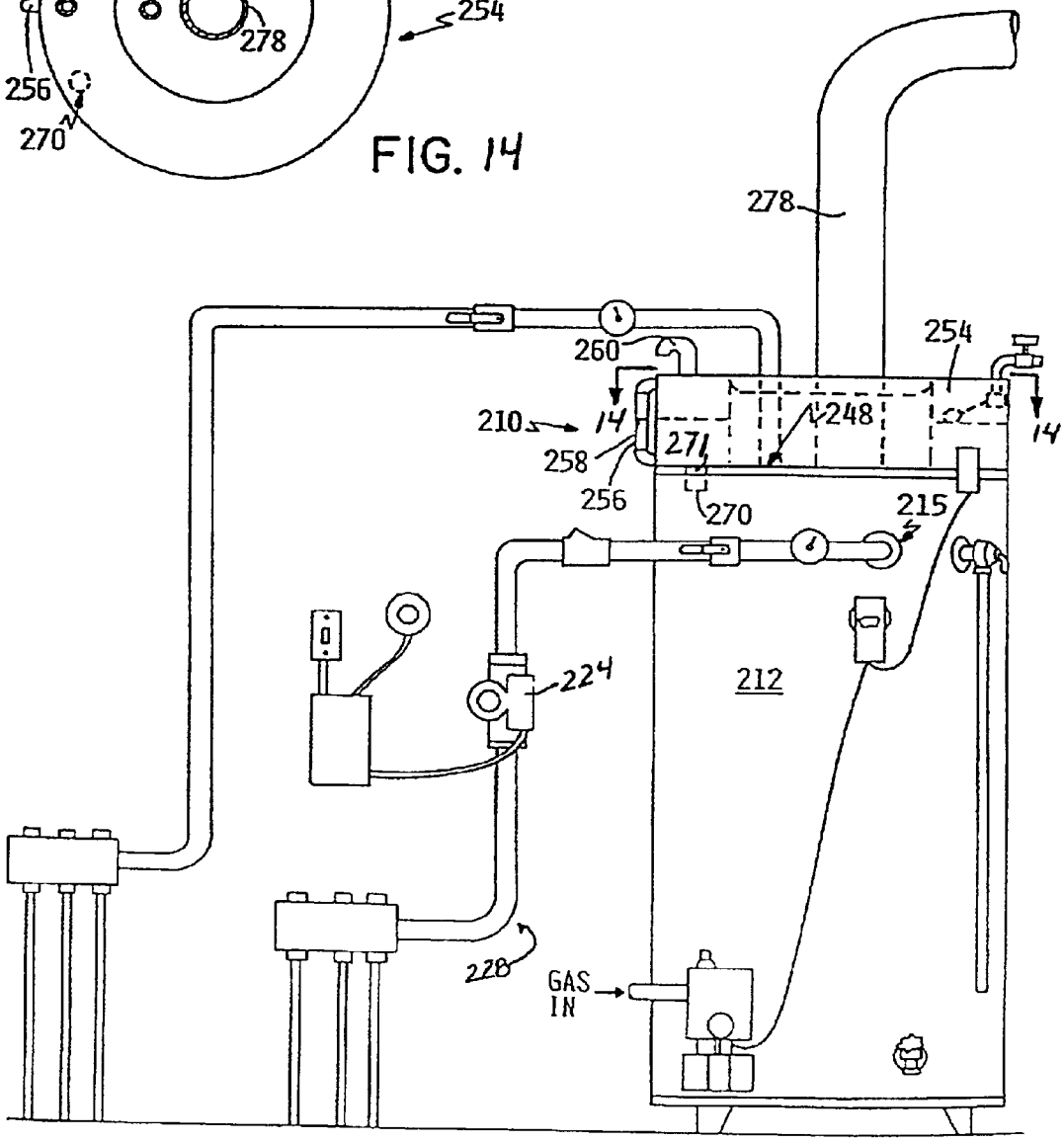
FIG. 13 is an elevation view of a resulting heating system utilizing a further embodiment of the invention.
Figure 15:
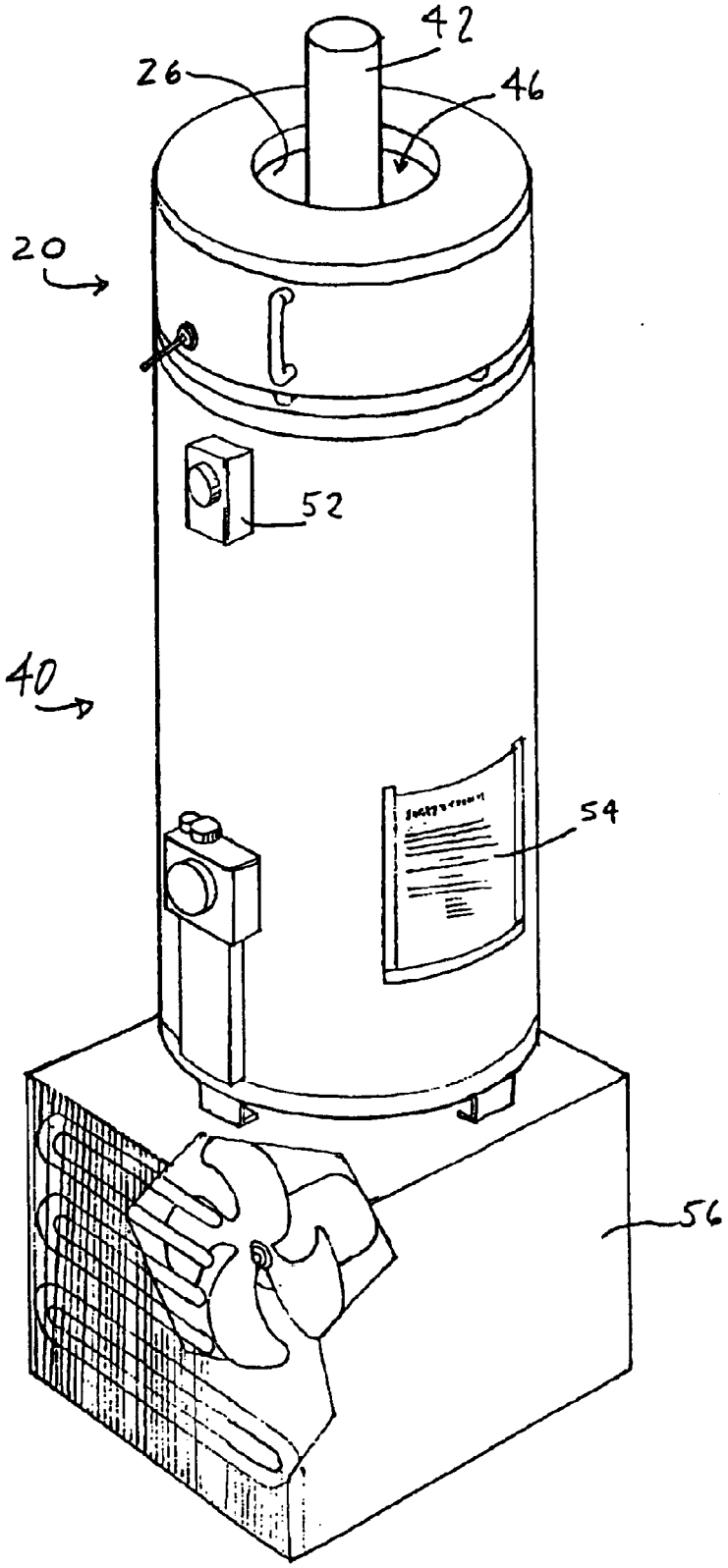
FIG. 15 is a Partial perspective view of one embodiment of the present invention, the heating vessel positioned atop a coil unit.

In another embodiment of the invention, a do-it-yourself hydronic space heating kit is provided. FIG. 13 illustrates one version of the completed system which assembly is made convenient by use of the kit. The kit utilizes components that are used in conjunction with a heat vessel 212 for heating liquid where the heat vessel 212 includes a flue 278 and the system includes piping 228 connected to the heat vessel for receiving heated liquid and circulating the heated liquid throughout coils (not shown) and back to the heat vessel. The kit includes a tank 254 as further detailed in the above description, together with a circulating pump 224 of a configuration suitable for connection to the system piping 228, and a connecting means such as a pipe nipple 271 for connecting the tank 254 to the vessel 212. Preferably connecting means includes a flexible tubing. Pipe nipple 271 may be used in conjunction with a vinyl tube to accommodate connection. The above components of the kit are most convenient for assembly of a desired system, but It can be appreciated that additional components may be included to accommodate easier assembly and lessen the time a worker needs to set-up the system. An instruction sheet 54 may be included with the kit.

Other components that may be found in the kit include a circulation pump having flanges 224, a high temperature limit switch for safety control and tempering valve, additional pipe nipples, 90 degree pipe elbows and hose barb fittings, tubing clamps, a line voltage thermostat 52 (for operation of the pump and/or fan), a thermocouple junction block adapter (for connecting the liquid level switch and high temperature limit switch to a millivolt gas valve), wiring harness to connect switches, a fan coil unit 56 mounted within a stand (as an alternative to coils set in concrete), heating coils, and instructions 54 for assembly of a non-externally pressurized space heating system. One such system is shown in patent application Ser. No. 09/416,608, which is incorporated herein by reference. It can be appreciated that the piping from the circulating system can be connected to an auxiliary or side port (not shown) of the vessel 212 so that such piping need not extend through the aperture.

As shown in FIG. 13, liquid from coils external to the vessel 212 returns to the vessel 212 through return port 248 which is defined in the vessel 212. Tank 254 is integrally connected to vessel 212. This may be preferred with a sealed combustion type vessel. It can be appreciated that tank 254 may be alternatively separated from vessel 212 for use with a draft hood for instance. In such case, return piping from the coils may be connected to return port 248 without extending through tank 254. Preferably, such piping would run beneath tank 254 for attachment to return port 248, or would run to a side port.

Figure 14:
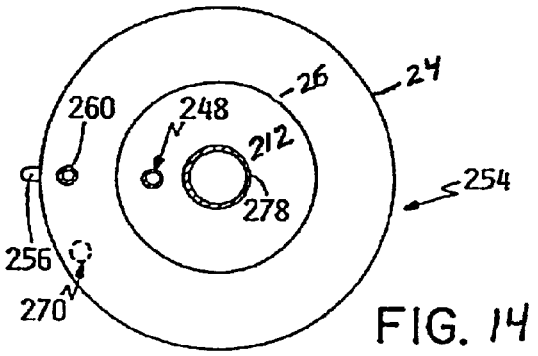
FIG. 14 is a top view of a tank component of the invention referenced in FIG. 13.

As shown in FIG. 14, tank 254 includes refill port 260, outlet port 270, indicator 256, inner tank wall 26 and outer tank wall 24. As shown in FIG. 14, tank 254 is positioned atop vessel 212. Flue 278 extends upward. Circulation piping which connects at return port 248 also extends upward through tank 254.

The advantages and improvements of the tank of the present invention are numerous. These advantages and improvements are enumerated with reference to employing the invention on a space heating system.

The tank of the present invention can be used in conjunction with a non-externally pressurized space heating system. The tank holds liquid which allows air bubbles to be released from the heating system. The tank also isolates the system from the open atmosphere to prevent introduction of air bubbles. The tank permits efficient and convenient installation above a heating vessel that utilizes a flue for removal of exhaust. This feature results in convenient and functional space location. The tank includes an aperture that also separates the tank from contact with the flue so as to avoid excessive heating of the liquid contained within the tank. This feature lessens the likelihood of liquid evaporation. The tank is easily installed atop a vessel and about the exhaust flue. The tank can also be economically fabricated using general manufacturing techniques.

While the present invention has been described with reference to several particular example embodiments, those skilled in the art will recognize that many changes may be made thereto without departing from the spirit and scope of the present invention, which is set forth in the following claims.

I claim:

1. A non-circulating tank for use with a liquid heating vessel of a non-externally pressurized space heating system, the heating vessel having a flue for release of exhaust, said tank comprising;

liquid holding means for holding liquid utilized with the heating system, said liquid holding means including a top having an opening to the atmosphere for releasing air from the system, said liquid holding means having an outer tank wall, an inner tank wall and a bottom tank wall;

connecting means for connecting said tank to the heating vessel so that liquid within said tank communicates with the vessel and so that air bubbles may migrate from the system to the atmosphere;

leg means for creating a separation between said tank and the heating vessel; and aperture means for receiving the flue which extends vertically through said aperture, said aperture means defined by said liquid holding means.

2. The tank according to claim 1 wherein said liquid holding means is doughnut shaped.

3. The tank according to claim 1 wherein said liquid holding means is horseshoe shaped.

4. A non-circulating tank for use with a heating vessel of a non-externally pressurized space heating system, the system of the variety having a heat vessel for heating liquid, piping connected to the heat vessel for receiving the heated liquid and circulating the heated liquid throughout coils and back to the heat vessel, the piping including a pump for circulating liquid through the piping and the coils, the heat vessel positioned above the coils and having a flue for release of exhaust, said tank comprising:

liquid holding means for holding liquid utilized with the heating system, said liquid holding means including a top having an opening to the atmosphere for releasing air from the system, said liquid holding means having an outer tank wall, an inner tank wall and a bottom tank wall;

connecting means for connecting said tank to the heating vessel so that liquid within said tank communicates with the vessel;

leg means for creating a separation between said tank and the heating vessel; and aperture means for receiving the flue which extends vertically through said aperture, said aperture means defined by said liquid holding means.

5. A do-it-yourself hydronic space heating kit for assembly of a space heating system utilizing a heat vessel for heating liquid, the heat vessel having a flue, piping connected to the heat vessel for receiving heated liquid and circulating the heated liquid throughout coils and back to the heat vessel, said kit comprising:

a non-circulating tank for holding water, said tank including an aperture adapted to receive the flue which extends therethrough, and said tank having releasing means for releasing air contained within the system;

a circulating pump sized to connect with the piping; and a connecting means for connecting said tank to the vessel.

6. A do-it-yourself hydronic space heating kit according to claim 5 wherein said kit includes a heating vessel.

7. A do-it-yourself hydronic space heating kit according to claim 5 wherein said kit includes a line voltage thermostat and instructions for assembly.

8. A do-it-yourself hydronic space heating kit according to claim 5 wherein said tank includes leg means for creating a separation between said tank and the heating vessel.

9. An improved method of radiant space heating of the type utilizing a heat vessel for heating liquid, the heat vessel having a flue, piping connected to the heat vessel for receiving heated liquid and circulating the heated liquid with at least one circulating pump throughout coils and back to the heat vessel, the improvement comprising the steps of:

providing a non-circulating tank comprising:

a liquid holding means for holding liquid in communication with the heat vessel, said liquid holding means including a top having an opening to the atmosphere for releasing air from the heat vessel, said liquid holding means having an outer tank wall, an inner tank wall and a bottom tank wall;

connecting means for connecting said tank to the heating vessel so that liquid within said tank communicates with the vessel and so that air bubbles may migrate from the heat vessel to the atmosphere;

leg means for creating a separation between said bottom tank wall and the heating vessel; and aperture means for receiving the flue which extends vertically through said aperture, said aperture means defined by said liquid holding means; and positioning said tank atop the heat vessel in a spaced separation position from the heat vessel;

whereby said tank is removed from contact with higher temperature sources in order to minimize temperature increases in the liquid within said tank.

10. An improved method of radiant space heating according to claim 9 wherein said positioning step includes positioning said tank in a spaced clearance position from the flue.

11. A tank for use with a liquid heating vessel of a hydronic radiant heating system, the heating vessel having a flue for release of exhaust, said tank comprising;

liquid holding means for holding liquid utilized with the heating system;

leg means for separating said liquid holding means from the heating vessel; and aperture means for receiving the flue which extends therethrough, said aperture means defined by said liquid holding means.

12. The tank according to claim 1 wherein said leg means includes a strip of material.

13. The tank according to claim 12 wherein said strip includes sheet metal.

14. The tank according to claim 1 wherein said leg means includes a leg.

* * * * *